US005367849A

United States Patent [19]

Bullock

[11] Patent Number: 5,367,849

[45] Date of Patent: Nov. 29, 1994

[54] INSULATION CONFIGURATIONS AND METHOD OF INSTALLATION

[76] Inventor: Thomas W. Bullock, 3321 Pines Rd., Shreveport, La. 71119

[21] Appl. No.: 941,904

[22] Filed: Sep. 8, 1992

[51] Int. Cl.[5] ..... E04B 2/00

[52] U.S. Cl. ..... 52/404; 52/743

[58] Field of Search ..... 52/406, 404, 407, 743.1

[56] References Cited

U.S. PATENT DOCUMENTS

| | | | |
|---|---|---|---|
| 4,107,892 | 8/1978 | Bellem | 52/404 X |
| 4,257,204 | 3/1981 | Rieger | 52/404 X |
| 4,284,674 | 8/1981 | Sheptak | 52/406 X |
| 4,441,294 | 4/1984 | Riley | 52/404 |
| 4,726,985 | 2/1988 | Fay | 52/404 X |
| 4,738,072 | 4/1988 | Clemensen | 52/404 X |
| 4,875,320 | 10/1989 | Sparkes | 52/404 X |
| 4,885,886 | 12/1989 | Rosso | 52/404 |

*Primary Examiner*—Carl D. Friedman
*Assistant Examiner*—Beth A. Aubrey

[57] ABSTRACT

Insulation configurations created by low density, loose-fill, particulate, blown insulation and/or fiber batt insulation in combination with high density, loose fill, particulate, blown and/or fiber batt insulation placed under or over the low density insulation, depending upon location. The insulation configurations are designed for, but are not limited to, attic insulation and floor insulation, where low density, loose-fill, particulate, blown and/or fiber batt insulation is normally used. The high density insulation so characterized isolates the low density insulation and greatly reduces air infiltration into, and circulation through, the resulting high and low density insulation configurations. The air infiltration or circulation which the insulation configurations are designed to minimize is generally characterized by, but is not limited to, heat-induced natural convection. A method of installing a high density layer of loose-fill, particulate, blown and/or fiber batt insulation under or over low density, loose-fill, particulate, blown and/or fiber bart insulation, for isolating the low density insulation and creating layered insulation configurations of high efficiency by reducing air infiltration into and through the insulation configurations.

17 Claims, 2 Drawing Sheets

INSULATION CONFIGURATIONS AND METHOD OF INSTALLATION

BACKGROUND OF THE INVENTION

1. Field of the Invention

This invention relates to the insulation of structures and similar insulation applications and more particularly, to insulation configurations for ceiling and floor structures. Through extensive tests, it has surprisingly been determined that the efficiency of low density, loose-fill , particulate, blown insulation, as well as low density fiber batt insulation, is greatly improved by placing additional similarly constituted high density insulation containing fiberglass or other insulation, over and under the low density insulation, depending upon the attic or floor application, to isolate the low density insulation and produce layered high density-low density insulation configurations of surprisingly high efficiency.

Recent extensive tests and studies have determined that current test methods for measuring the efficiency of insulation do not accurately predict the "in place performance" of low density fiber, loose-fill, particulate, blown insulation. The three current test methods commonly used in the industry to measure performance of insulation are the "Guarded Hot Plate", "Guarded Hot Box" and the "Calibrated Hot Box" techniques. All three test methods induce heat on one side of the insulation while the insulation is contained and not exposed to the atmosphere and measure the heat which passes through the insulation. From these tests, a thermal conductivity coefficient, (K) is determined and this thermal conductivity coefficient is used to calculate the thermal resistance, (R) of the insulation. These data are then used by architects and engineers to design and predict the thermal efficiency of structures.

2. Description of the Prior Art

In the construction of homes, buildings and other structures, wall configurations are typically assembled from vertical studs and insulation is placed between the studs. It is generally assumed that this insulation prevents air circulation between the studs. However, in contradiction to this technology, conventional wall construction provides for "weep" or ventilation holes at the bottom of the wall and the insulation is thusly vented to the attic, to permit the wall to "breathe". The discoveries outlined in this application make it reasonable to assume that this "breathing" of the wall deteriorates the efficiency of the insulation to a degree much greater than expected. The "breathing", or heat-induced natural convection, also exists in the low density, loose-fill particulate or fiber batt insulation in attics and under floors and can be reduced by placing high density horizontal batt or pillow insulation barriers over or under the low density insulation, to seal the insulation from convection and create high efficiency, layered insulation configurations characterized by closed cells within the attic and floor structures. The teachings of this invention thus dictate that the first reason these layered insulation configurations are more thermally efficient, is that air is more easily trapped in the low density insulation layer. Secondly, the high density-low density layers combine in a synergistic manner to create more efficiency than is possible in a homogeneous layer of insulation of the same thickness. Consequently, according to a preferred embodiment of this invention, the layers of insulation are combined to incorporate a first layer of fibrous, loose-fill, particulate, blown insulation of high density over or under a low density insulation layer, depending upon location, to provide more thermally efficient insulation configurations.

In order to better understand the phenomena which take place in the insulation configurations of this invention, a highly effective apparatus was designed for conducting tests which accurately measure and predict the "in place performance" of fiber insulation layered according to this invention in building structures. The test results are outlined in FIG. 6 of the drawings.

Various types of insulation configurations have been patented over the years. Typical of these insulation configurations is the "Wall Insulation" detailed in U.S. Pat. No. 2,283,257, dated May 19, 1942, to M. A. Jorsch. The wall insulation includes inner and outer sheets of cellular fiberboard located within a wall to form a chamber between the sheets, which chamber acts as a dead air space and increases the insulation efficiency of the wall. U.S. Pat. No. 2,804,657, dated Sep. 3, 1957, to C. G. Munters, details "Heat Insulated Walls of Cold-Storage Rooms." The heat insulated walls include a spaced outer casing and an inner lining, with a diffusion barrier located adjacent to the casing on the iiner side and further including heat insulating material located between the casing and the lining. U.S. Pat. No. 4,047,346, dated Sep. 13, 1977, to Robert J. Alderman, details a "Chicken Wire Roof and Method of Insulation". An insulated roof structure is formed on the industrial building by mounting a support framework on the purlins in the partially completed roof structure and moving the framework along the length of the purlins. A reel of wire mesh and a reel of sheet material are carried by the framework over each of the spaces between adjacent ones of the purlins and as the reels are progressively unrolled, layers of wire mesh and sheet material are applied to the spaces between the purlins while the support framework moves. Additional insulation can be blown upon or otherwise applied to the sheet material to fill the spaces between the purlins and hard sheets of roofing material are applied to the purlins as the support framework progresses across the structure. U.S. Pat. No. 4,696,138, dated Sep. 29, 1987, to Christopher A. Bullock, details "InsulationConfigurations and Method of Increasing Insulation Efficiency". Insulation configurations for the ceiling, floor and walls of structures include at least one layer of particulate or "blown" insulation, with a water vapor-permeable film or films isolating the layer or layers to limit air circulation and infiltration through the layers. Multi-layered insulation batts for building structures are detailed in U.S. Pat. No. 4,700,521, dated Oct. 20, 1987, to Craig H. Cover. The patent details thermal insulation for walls, ceilings and floors of building structures, which insulation contains alternating layers of low emissivity sheets and batts of low heat conductive material, laminated to form a single insulation batt. A "Method and Apparatus for Installing Insulation" is detailed in U.S. Pat. No. 4,724,651, dated Feb. 16, 1988, to Robert E. Fligg. Multiple sheets of vinyl-backed, fiberglass insulation are fastened side-by-side to each other to cover the area to be insulated. Purlin clips having an aperture therein are used to thread a band of metal therethrough for supporting the bottom side of the vinyl sheets at even intervals along their lengths.

It is an object of this invention to provide new and improved insulation configurations for insulating the attics and floors of homes, offices, and other structures, which insulation configurations are characterized by a first batt or particulate insulation layer of high density capping a second mass of low density, particulate insulation and resting on the ceiling in the attic and between floor joists, respectively, which high density insulation serves to isolate the low density particulate insulation to minimize air circulation through the low density insulation and combine in a synergistic manner with the low density insulation to increase insulating efficiency.

Another object of this invention is to provide an improvement to existing low density insulation in an insulated attic having a layer of sheetrock or other interior material attached to the bottom of supporting attic ceiling joists, wherein the mass of low density insulation is located between the ceiling joists, supported by the sheetrock, which improvement includes placing high density insulation having a selected thickness and density over the low density insulation to create a layered insulation configuration and minimize the movement of air through the insulation layers to thereby improve the thermal efficiency of the insulation.

A still further object of the invention is to provide an improved insulation configuration for the attics and floors of structures, which insulation configuration includes fiberglass batts or pillows of high density and thickness covering a quantity of low density insulation installed on sheetrock between the ceiling joists of the attic and between floor joists, which batts or pillows serve to isolate the low density insulation and combine with the low density insulation to substantially prevent air from circulating through the combined layers of insulation and increase the efficiency of the insulation configuration, while allowing moisture to move through the insulation layers without collecting therein and damaging the insulation, the underlying sheetrock or any structural members.

Yet another object of the invention is to provide an improved insulation configuration which includes a high density fibrous, loose-fill particulate, or blown insulation placed over a mass of low density insulation to at least partially isolate the low density insulation and create a high density-low density laminate which is characterized by decreased air infiltration and circulation.

Still another object of this invention is to provide a method for increasing the efficiency of insulation in the attics and floors of structures, which method includes the expedient of placing insulation batts or pillows of high density and selected thickness over the low density insulation, in order to isolate the low density insulation and minimize circulation of air through the resulting layers or cells of high and low density insulation.

A still further object of the invention is to provide a method for minimizing the circulation of air and heat through a layered insulation configuration characterized by a low density particulate or batt insulation and a high density insulation cap installed in the attics and floors of structures, which method includes installing high density insulation batts or pillows, or an alternative high density, water vapor-permeable insulation cap or cover, over the low density insulation, in order to substantially isolate the layered insulation combination from air infiltration and circulation.

SUMMARY OF THE INVENTION

These and other objects of the invention are provided in insulation configurations for enhancing the insulating capability of attics and floors, which configurations include particulate or batt insulation of high density positioned over particulate or batt-type, low density insulation, to define layered insulation structures which isolate the low density insulation and minimize air circulation through the resulting insulation configurations. A method for reducing air flow through high and low density insulation laminates located in the attic and beneath the floor of a structure and thereby increasing the efficiency of the insulation, which method includes placing high density, water vapor-permeable particulate insulation or insulation batts or pillows over the low density insulation to substantially isolate the layered insulation configuration from air circulation.

BRIEF DESCRIPTION OF THE DRAWING

The invention will be better understood by referenced to the accompanying drawing, wherein.

DESCRIPTION OF THE PREFERRED EMBODIMENTS

Figure 1:
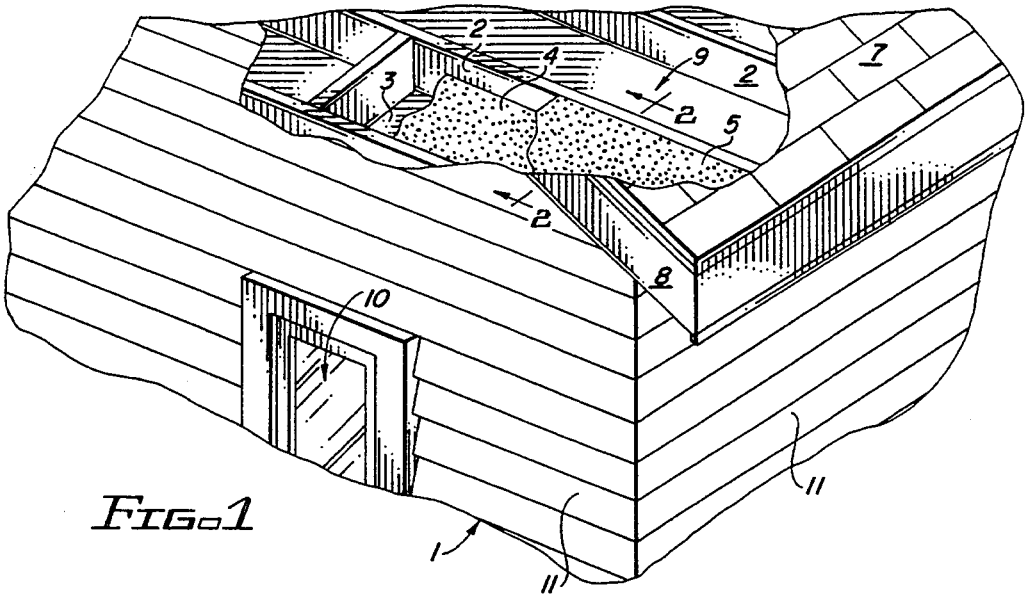
FIG. 1 is a perspective view, partially in section, of a structure with the attic area open to inspection and illustrating a preferred mass of low density, particulate insulation capped by a high density insulation batt to define an insulation configuration of this invention.
Figure 2:
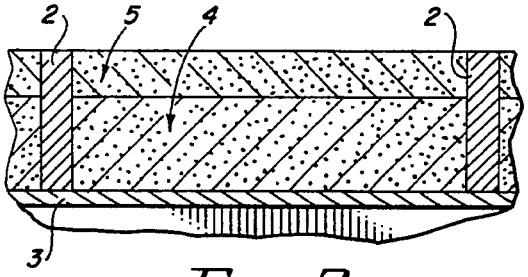
FIG. 2 is a sectional view taken along line 2—2 of a segment of the layered insulation configuration illustrated in FIG. 1.

Referring initially to FIG. 1 of the drawings, a structure 1 is illustrated with walls 11, a window 10 and an attic 6, having a roof 7, carrying roof trusses 8. As illustrated in FIGS. 1 and 2, a preferred insulation configuration for the attic 6 is generally illustrated, with a first layer of blown, particulate, low density insulation 4 located between the ceiling joists 2 and resting on the ceiling material 3 attached to the bottom of the ceiling joists 2. An insulation batt 5 of high density and selected thickness is positioned over the first layer of low density insulation 4 between the ceiling joists 2, to isolate the low density insulation 4 and complete the insulation configuration. The low density insulation 4 is typically applied to the ceiling material 3 and located between the ceiling joists 2 by means of a blowing apparatus, in the case of particulate, loose-fill insulation such as fiberglass and the like. Alternatively, shaped, covered or uncovered low density batts or rolled sheets of non-solid, fibrous insulation may be applied on the ceiling material 3 between the ceiling joists 2, by techniques which are well known to those skilled in the art. As further illustrated in FIG. 1, the ceiling material 3, which is typically "sheetrock" or "gypsum board" material, serves to prevent air encroachment or infiltration into the low density insulation 4 from the bottom, or interior of the structure 1. The insulation mass is isolated on the top by the high density insulation batt 5 to create a layered insulation configuration which effectively limits air infiltration and circulation and reduces heat transfer.

Figure 3:
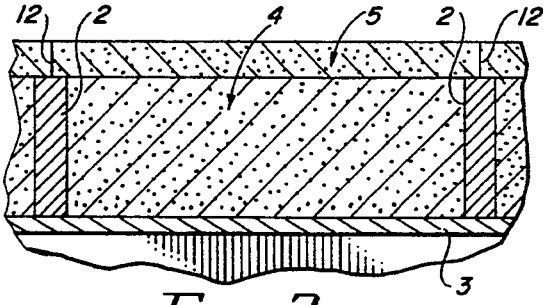
FIG. 3 is a sectional view of a layered insulation configuration having a slightly different installation orientation.

Referring now to FIG. 3 of the drawings, a second insulation configuration is illustrated, wherein high density insulation batts 5 are placed over the ceiling joists 2 and butted end-to-end, thereby further sealing the top of the underlying low density insulation 4. Accordingly, air cannot readily enter or circulate through either the high density insulation batts 5 or the low density insulation 4, due to the presence of the high density insulation batts 5. The efficiency of the resulting layered insulation configuration located between and on the ceiling joists 2 is found to be surprisingly higher than it would normally be under circumstances where only a single thickness of high density insulation 5 or low density insulation 4 is used.

Figure 4:
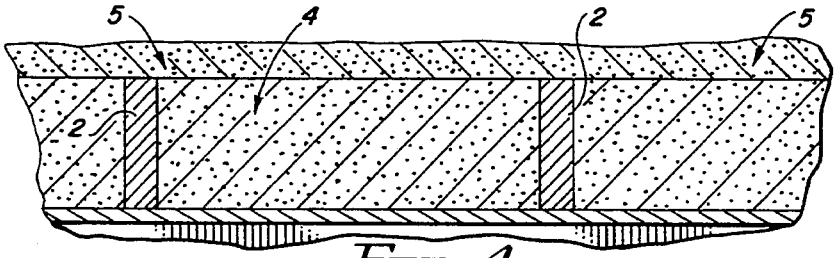
FIG. 4 is another layered insulation configuration illustrating the use of loose-fill or particulate insulation of selected high density and thickness to cover underlying low density, particulate insulation.

Referring now to FIG. 4, blown, loose-fill or particulate high density insulation 6 replaces the high density insulation batts 5, illustrated in FIGS. 1-3. This blown, loose-fill or particulate high density insulation 6 may be installed according to the knowledge of those skilled in the art.

Figure 5:
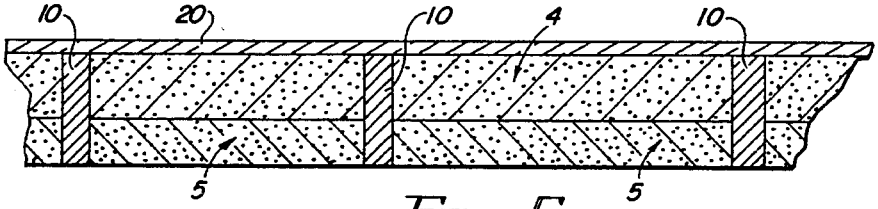
FIG. 5 is a sectional view of a floor segment illustrating a preferred high density batt-low density particulate insulation configuration of this invention.

Referring to FIG. 5 of the drawings, in a third insulation configuration a floor decking 20 is nailed or otherwise mounted to the top edges of parallel, spaced floor joists 10 and high density insulation batts 5 are positioned under a layer of low density insulation 4, which lies adjacent to the floor decking 20 and between the floor joists 10. The high density insulation batts 5 may be stapled or otherwise secured in this position by methods known to those skilled in the art, to define a first layer of insulation.

As detailed in U.S. Pat. No. 4,696,138, to Christopher A. Bullock, a water vapor-permeable film positioned over particulate, low density insulation increases insulation efficiency by minimizing air circulation into the low density insulation. As indicated above, it has surprisingly been found that a high density insulation cap placed over low density particulate insulation creates a layered insulation configuration, using either the high density insulation batts 5 or blown, loose-fill or particulate high density insulation 6, which is particularly effective to achieve this objective. The high density insulation batts 5 and blown, loose-fill or particulate high density insulation 6 illustrated in FIGS. 1 and 4, are not encapsulated in or covered by a moisture vapor-permeable film or cover.

Figure 6:
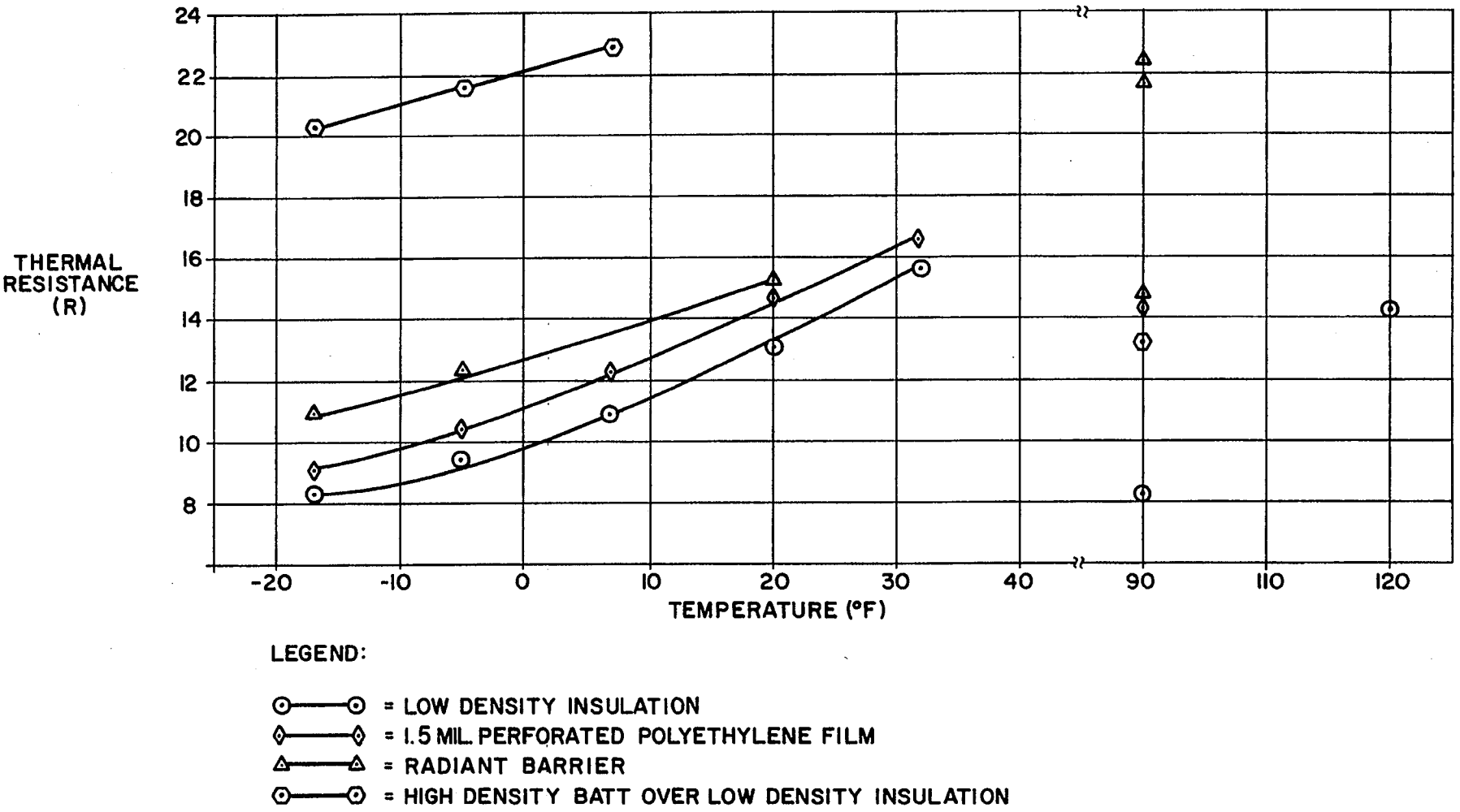
FIG. 6 is a graph plotting temperature versus "R" value for various insulation configurations.

The following insulation configurations numbered 1–6 were tested for thermal insulation efficiency and the pertinent results are compiled in the graph illustrated in FIG. 6. The temperatures plotted on the graph are simulated outside ambient conditions and the temperature at ttle bottom surface of the ceiling material 3 was maintained at 70°, ±0.1° F.

1. A highly instrumented attic structure with no insulation installed over the ½ inch gypsum board ceiling.

2. The attic structure described in 1, with approximately ten (10) inches of low density, R 21 blown fiberglass insulation in place over the gypsum board ceiling.

3. The insulated attic described in 2 with a one (1) sheet of DuPont "Tyveck" radiant barrier located over the low density, R 21 blown insulation.

4. The insulated attic described in 2 with one layer of 1.5 mil perforated polyethylene film positioned over the low density, R 21 blown insulation.

5. The insulated attic described in 2 with a one-inch thick, low density fiberglass batt (0.75 lb. per cubic ft. density) encapsulated in the polyethylene film.

6. The insulated attic described in 2 with a one-inch thick high density batt (1.0 lb. per cubic ft. density) placed over the low density, R 21 blown fiberglass insulation.

The tests were conducted in simulated summer and winter conditions and confirmed that the "R" values for the low density, R 21 blown fiberglass insulation were less than one-half of the rated R 21 value in some winter conditions and were significantly lower than the R 21 value for all winter conditions. During summer conditions, the insulation also performed below the expected rated R 21 value. In all cases, when a convection barrier, cap or cover was placed over the low density, R 21 blown insulation, the insulation performance was improved.

The attic structure was initially tested for thermal efficiency with no insulation installed, in order to determine in future tests the true contribution of the various test insulation configurations. It was determined from one winter test at 0.0 degrees F., that the "R" value of the bare gypsum board ceiling was 1.5 and the same was true at 90 degrees F., for a summer test. This is three times higher than the values predicted by current architectural manuals, which list a value of R 0.5 for the gypsum board ceiling.

The next test consisted of blowing low density, R 19 glass fiber insulation into the attic structure by a quaified insulation contractor. It was determined after the installation, by weighing the glass fiber before and after installation and measuring the thickness of the insulation, that the actual "R" value of the low density, R 19 blown insulation was R 21. It was determined that the highly accurate, true, in-place "R" value ranged from R 8.3 at −18 degrees F., to R 12.9 at 20 degrees F., for winter conditions. Summer tests were conducted at 90 degrees F. and 120 degrees F. and ranged from R 9.2 to R 14.1, respectively. These data are plotted on the graph illustrated in FIG. 6.

A radiant barrier was installed over the low density, R 21 blown glass fiber insulation and tested in both simulated winter and summer conditions. The winter test showed an increase in "R" value over the low density, R 21 blown insulation of approximately R 2.5 for all conditions. There were two summer tests conducted at 90 degrees F. and the "R" values were 22.6 and 23.3, respectively. This generally agrees with previous radiant barrier tests which have shown a decrease in heat flux of 40% to 50% when the radiant barriers are placed over low density attic insulation during summer conditions. These data are also plotted in the graph illustrated in FIG. 6.

The radiant barrier was then removed from the attic simulator and was replaced with a single layer of 1.5 mil. perforated polyethylene film. The film configuration consistently performed at approximately R 1 higher than the low density, R 21 blown glass fiber insulation and R 1 lower than the radiant barrier configuration for winter tests. At the summer condition of 90 degrees F., the "R" value was 17.9. These data are plotted in the graph illustrated in FIG. 6.

The single layer of perforated polyethylene film was then removed from the top of the low density, R 21 blown glass fiber insulation and replaced with a one-inch thick, low density glass fiber batt which was encapsulated in the 1.5 mil. perforated polyethylene film.

The film was heat-sealed on the edges and open on the ends to define a "pillow". The ends were, however, stapled to partially seal the pillow. The winter tests indicated a significant increase in "R" value, which was expected. The "R" value ranged between R 20 and R 21 when the temperature was in the range from −5 degrees F. and 45 degrees F. The "R" value at −18 degrees F. was 17.1 and the summer condition at 90 degrees F., was 17.9. These data are also plotted in the graph illustrated in FIG. 6.

A one-inch thick high density (1.1 lb./cu. ft.) batt was placed on the low density, R 21 blown glass fiber insulation in place of the low density pillow. It was unexpectedly determined that the "R" value of the resulting insulation configuration was increased by all average of R 2.5 over the one-inch thick low density pillow configuration. The tests were conducted at low temperature only and the "R" values ranged between R 20.2 at −18 degrees F., to R 22.8 at 5 degrees F. These data are also plotted on the graph illustrated in FIG. 6.

The data presented on the graph illustrated in FIG. 6 clearly shows that the one-inch thick high density insulation batt creates a superior insulation configuration when placed over the low density blown insulation and the same could be expected of high density loose-fill, fibrous, blown or particulate insulation.

The term "low density" is used herein to refer to particulate or batt insulation having a density generally in the range of from about 0.40 to about 0.75 pounds per cubic foot, while "high density" refers to insulation having a density above about 0.75 pounds per cubic foot and preferably in the range of from about 0.75 to about 10 pounds per cubic foot. Most preferably, the density of the high density insulation is in the range of from about 0.75 to about 4 pounds per cubic foot.

Test data which were recorded during this research proves by both heat flow measurements and infra-red video photography that air does circulate through low density glass fiber insulation and that at least one of the transport forces for this air circulation is heat-induced natural convection. Data from this research and data from the "Guarded Hot Plate" test for years have indicated that high density glass fiber insulation does conduct more heat than low density glass fiber insulation. Therefore, high density glass fiber insulation has a higher "K" value, or heat transfer coefficient, than low density glass fiber insulation. By definition, this will produce a lower calculated "R" value for high density insulation than for low density insulation.

However, test data which were recorded during this research also proves that a high density glass fiber batt which was one (1) inch thick and had a density of 1.1 lb/cu-ft. reduced air circulation and heat-induced natural convection through the mass of insulation to a level which was not measurable or identifiable during these tests. This was also confirmed by both heat flow measurements and infra-red video photography of the surface of the insulation.

It is apparent from the above data that under circumstances where a high density fiber insulation is placed over low density fiber insulation, the configuration produces a low density, low heat-conducting cavity inside the insulation mass and a high density cap on top of the insulation mass which minimizes air infiltration and circulation into or through the insulation mass. The result is an insulation configuration which is surprisingly superior to either of the single high density or low density configurations.

It is felt that high density insulation alone may be highly effective in reducing air infiltration in, and heat transfer through, the insulation mass. This insulation may be in the form of blown (particulate) insulation or insulation batts or pillows. Furthermore, while high density insulation batts and pillows were used in the test program, it will be understood that high density blown or particulate insulation or any other form of high density insulation is equally well suited for the purpose of this invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A fiberglass insulation configuration for attic and floor structures, comprising at least one layer of low density of 0.4 to 0.8 pcf fiberglass insulation positioned adjacent to said attic and floor structure and at least one layer of high density of 0.8 to 6.0 pcf fiberglass insulation positioned horizontally on the exterior of said low density fiberglass insulation and exposed to the air, whereby air circulation into said high density fiberglass insulation and said low density fiberglass insulation is reduced.

2. The fiberglass insulation configuration of claim 1 wherein said low density fiberglass insulation further comprises particulate fiberglass insulation.

3. The fiberglass insulation configuration of claim 1 wherein said high density fiberglass insulation further coinprises fiberglass insulation batts.

4. The fiberglass insulation configuration of claim 1 wherein said high density fiberglass insulation further comprises high density particulate fiberglass insulation and said low density fiberglass insulation further comprises low density particulate fiberglass insulation.

5. The fiberglass insulation configuration of claim 1 wherein said low density fiberglass insulation further comprises fibrous fiberglass insulation.

6. The fiberglass insulation configuration of claim 1 wherein said high density insulation further comprises fibrous insulation batts.

7. The fiberglass insulation configuration of claim 6 wherein said fibrous fiberglass insulation batts are characterized by loose-fill, particulate, fibrous fiberglass insulation.

8. A fiberglass insulation configuration for attics having an attic floor, comprising a layer of low density of 0.4 to 0.8 pcf fiberglass insulating material located adjacent to the attic floor and a layer of high density of 0.8 to 6.0 pcf fiberglass insulating material positioned horizontally over said low density insulating material and exposed to the air to isolate said low density fiberglass insulation material, whereby circulation of air into said high density insulating material and said low density insulating material from the air is reduced.

9. The fiberglass insulation configuration of claim 8 wherein said high density insulating material further comprises fiberglass insulation batts.

10. The fiberglass insulation configuration of claim 8 wherein said low density fiberglass insulation further comprises low density, particulate fiberglass insulation.

11. The fiberglass insulation configuration of claim 8 wherein said low density insulating material further comprises low density fibrous fiberglass insulation and said high density insulating material further comprises high density, fibrous fiberglass insulation.

12. The fiberglass insulation configuration of claim 9 wherein said fiberglass insulation batts are further characterized by loose-fill, particulate fiberglass insulation.

13. A fiberglass insulation configuration for a floor structure comprising a layer of low density of 0.4 to 0.8 pcf insulating material located adjacent the floor structure and a layer of high density of 0.8 to 6.0 pcf insulating material positioned horizontally under and contacting said low density insulating material and exposed to the air to isolate said low density fiberglass insulation material, whereby circulation of air into said high density insulating material and said low density insulating material from the air is reduced.

14. The fiberglass insulation configuration of claim 13 wherein said high density insulating material further comprises fiberglass insulation batts.

15. The fiberglass insulation configuration of claim 13 wherein said low density insulating material further comprises low density, fibrous fiberglass insulation and said high density insulating material further comprises high density, fibrous fiberglass insulation.

16. A method for increasing the efficiency of a low density of 0.4 to 0.8 pcf fiberglass insulation layer positioned adjacent to the floor of an attic, comprising installing at least one layer of high density of 0.8 to 6.0 pcf fiberglass insulation horizontally in contact with said low density fiberglass insulation layer with said high density fiberglass insulation exposed to the air, to reduce air circulation into and through said high density fiberglass insulation and said low density fiberglass insulation

17. A method for increasing the efficiency of a low density of 0.4 to 0.8 pcf fiberglass insulation layer positioned adjacent to the underside of the floor of a structure, comprising installing at least one layer of high density of 0.8 to 6.0 pcf fiberglass insulation horizontally in contact with said low density fiberglass insulation layer with said high density fiberglass insulation exposed to the air, to reduce air circulation through said high density fiberglass insulation and said low density fiberglass insulation.

* * * * *